US009836075B2

(12) United States Patent
Chen et al.

(10) Patent No.: US 9,836,075 B2
(45) Date of Patent: Dec. 5, 2017

(54) METHOD AND APPARATUS FOR GENERATING A DIRECT CURRENT BIAS

(71) Applicant: STMicroelectronics (Shenzhen) R&D Co. Ltd, Shenzhen (CN)

(72) Inventors: Min Chen, Shenzhen (CN); Wen Liu, Shenzhen (CN); Hong Xia Li, Shenzhen (CN)

(73) Assignee: STMicroelectronics (Shenzhen) R&D Co. Ltd, Shenzhen (CN)

( * ) Notice: Subject to any disclaimer, the term of this patent is extended or adjusted under 35 U.S.C. 154(b) by 144 days.

(21) Appl. No.: 14/521,536

(22) Filed: Oct. 23, 2014

(65) Prior Publication Data

US 2015/0115927 A1 Apr. 30, 2015

(30) Foreign Application Priority Data

Oct. 25, 2013 (CN) ..... 2013 1 0521075

(51) Int. Cl.

| | |
|---|---|
| ***G05F 1/00*** | (2006.01) |
| ***G05F 5/00*** | (2006.01) |
| ***G05F 3/20*** | (2006.01) |

(52) U.S. Cl.

CPC ..... *G05F 5/00* (2013.01); *G05F 3/205* (2013.01)

(58) Field of Classification Search

CPC ..... H01L 2924/00; H03G 3/3047; H03G 3/3042

See application file for complete search history.

(56) References Cited

U.S. PATENT DOCUMENTS

| | | | | |
|---|---|---|---|---|
| 6,802,875 | B1 * | 10/2004 | Kimbara | C01B 3/26 48/61 |
| 2004/0212434 | A1 * | 10/2004 | Nagamori | H03F 1/301 330/285 |
| 2008/0157865 | A1 * | 7/2008 | Smith | H03F 1/56 327/553 |
| 2010/0315157 | A1 * | 12/2010 | Na | G05F 1/465 327/539 |
| 2011/0218432 | A1 * | 9/2011 | Tumer | A61B 6/00 600/431 |

FOREIGN PATENT DOCUMENTS

CN 203825517 U 9/2014

OTHER PUBLICATIONS

Chinese First Office Action and Search Report dated Oct. 10, 2015 for co-pending CN Appl. No. 201310521075.X (5 pages).

* cited by examiner

*Primary Examiner* — Sibin Chen
(74) *Attorney, Agent, or Firm* — Gardere Wynne Sewell LLP

(57) ABSTRACT

A voltage detector operates to detect a system power supply voltage and generate a trigger signal. A control signal generator responds to the trigger signal and generates a control signal. A DC bias generator responds to the control signal by generating a DC bias. The control signal controls the DC bias to have a first value when the power supply voltage is a first voltage and have a second value when the power supply voltage is a second voltage different from the first voltage, wherein the first value is different from the second value. A dynamic DC bias is generated which can not only support a larger voltage scope, but also significantly improves signal to noise ratio. The system power supply detection may concern stop/start operation of an automobile engine.

64 Claims, 5 Drawing Sheets

METHOD AND APPARATUS FOR GENERATING A DIRECT CURRENT BIAS

PRIORITY CLAIM

This application claims priority from Chinese Application for Patent No. 201310521075.X filed Oct. 25, 2013, the disclosure of which is incorporated by reference.

TECHNICAL FIELD

Embodiments of the present disclosure relate to the field of automobile engines, and more specifically, relate to an apparatus and method for generating a direct current (DC) bias.

BACKGROUND

Start-stop technology of an automobile engine is a new type of environmental friendly automobile technology that has been developed in recent years. According to this technology, when an idle speed condition is satisfied during the travelling of an automobile, the automobile engine will automatically stall so as not to operate. Conversely, when it is required to continue advancing, the automobile will quickly respond to a start command to quickly re-start the engine, thereby realizing an instant transition. Since the automobile engine does not work during each temporary stall, there is a reduction in fuel consumption and exhaust emission.

Generally, when the automobile engine is restarted after stalling, the power supply voltage of the system will drop to a lower value from a normal voltage within a short time, and then gradually rise to the normal voltage after a start condition is satisfied. This is shown in FIG. 1. As shown in FIG. 1, a normal power supply voltage of an automobile signal processor is usually 12V, for example, while during the start/stop operation of the automobile engine, the power supply voltage of the automobile signal processor will drop to a lowest voltage, e.g., 4.5V. In order to provide an automobile engine start/stop functionality, the automobile signal processor needs to work in a broad voltage range from the lowest voltage to the normal power supply voltage. Therefore, a DC voltage of a device will be biased to a lower value so as to support the broad operation range. However, a lower bias voltage will restrict swing of internal signals of the system, which means a signal to noise ratio will be lowered; in this way, signal quality during the normal operation will be degraded.

Therefore, there is a need in the art for an improved solution with respect to the automobile engine start/stop technology.

SUMMARY

In view of the above, the present disclosure provides a solution of generating a DC bias so as to overcome or alleviate at least a part of defects existing in the automobile engine start/stop operation in the prior art.

According to one aspect of the present disclosure, there is provided an apparatus for generating a DC bias. The apparatus may comprise: a voltage detector configured to detect a system power supply voltage and generate a trigger signal at an output end; a control signal generator configured to receive the trigger signal and generate a control signal for controlling generation of a DC bias; and a DC bias generator configured to receive the control signal at a control input end, and generate a DC bias based on the control signal, such that the DC bias with a first value is generated when the power supply voltage is a first voltage, while the DC bias with a second value is generated when the power supply voltage is a second voltage different from the first voltage, wherein the first value is different from the second value.

According to a second aspect of the present disclosure, there is provided a method for generating a direct current DC bias. The method may comprise: detecting a system power supply voltage and generating a trigger signal; generating a control signal for controlling generation of a DC bias based on the trigger signal; and generating the DC bias based on the control signal, such that the DC bias having a first value is generated when the power supply voltage is a first voltage, while the DC bias having a second value is generated when the power supply voltage is a second voltage different from the first voltage, wherein the first value is different from the second value.

With embodiments of the present disclosure, a dynamic DC bias may be realized, which may not only support a larger voltage range, but also significantly improve the signal to noise ratio of signals during normal operation. Moreover, in preferred embodiments, a smooth transition of DC bias may be implemented in a simple and cost-effective manner.

BRIEF DESCRIPTION OF THE DRAWINGS

Features, advantages, and other aspects of various embodiments of the present disclosure will become more apparent with reference to the detailed description in conjunction with the accompanying drawings, throughout which same reference numerals indicate same or like elements or components and wherein.

DETAILED DESCRIPTION OF THE DRAWINGS

Hereinafter, various exemplary embodiments of the present disclosure will be described in detail with reference to the accompanying drawings. It should be appreciated that these figures and description only relate to exemplary preferred embodiments. It should be noted that based on the following description, those skilled in the art will readily conceive alternative embodiments of the structures and methods disclosed herein, and these alternative embodiments may be used without departing from the idea of the disclosure as claimed.

It should be understood that these embodiments are provided only to enable those skilled in the art to better understand and in turn practice the present disclosure, not intended for limiting the scope of the present disclosure in any manner.

Next, FIGS. 2 to 11 will be referenced to describe a technical solution of generating a DC bias according to embodiments of the present disclosure.

Figure 1:
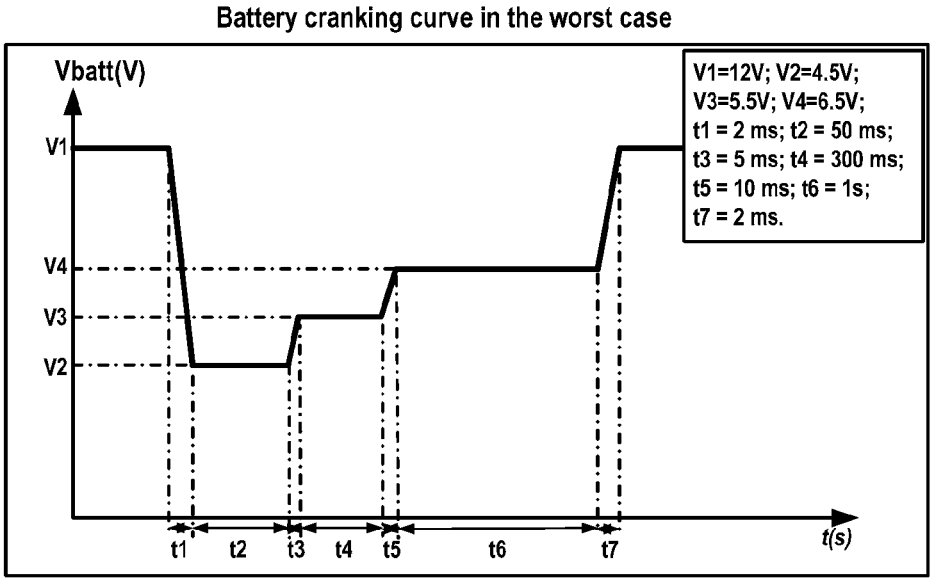
FIG. 1 schematically shows an exemplary diagram of a battery cranking curve in the worst case during automobile engine start/stop operations.
Figure 2:
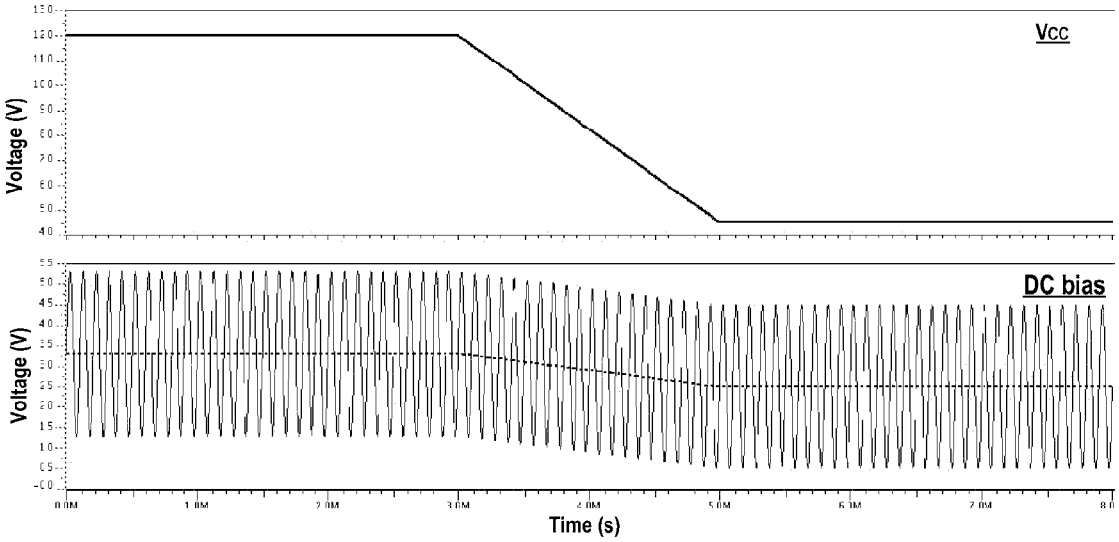
FIG. 2 schematically shows a diagram of a dynamic DC bias as provided in the present disclosure.

First, reference is made to FIG. 2, in which a schematic diagram of a dynamic DC bias according to an embodiment of the present disclosure is schematically presented. As mentioned above, in order to support a broad work range, the device DC voltage is biased to a lower value, which causes a restriction on swing of internal signals of the system and in turn degrades the signal to noise ratio. In order to solve the above problem, the inventors envisage adopting a solution of dynamic DC bias, i.e., dynamically changing the DC bias for different power supply voltages. As shown in FIG. 2, according to this solution, under a normal operation state, i.e., when the power supply voltage of the vehicle signal processor is relatively high (e.g., 12V), the DC bias may be maintained at a higher value (e.g., 3.3V); while during the start/stop operation of the automobile engine, when the power supply voltage drops to a lower value (e.g., 4.5V), the DC bias is caused to have a lower value (e.g., 2.5V). Preferably, the switch process has a smooth transition, i.e., realizing a soft handover, which may reduce or eliminate potential sharp noise during switch and reduce the impact on the signal quality. In this manner, it not only supports a broad work range of the signal processor of an automobile, and meanwhile reduces the limit to swing of internal signals of the signal during the normal operation period as much as possible, thereby enhancing the signal to noise ratio and improving the signal quality.

Figure 3:
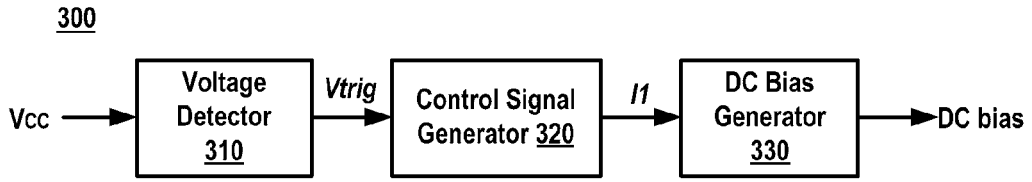
FIG. 3 schematically shows a block diagram of an apparatus for generating a DC bias according to an embodiment of the present disclosure.

To this end, there is provided a technical solution for generating DC bias for an automobile engine start/stop application. FIG. 3 schematically shows a block diagram of an apparatus 300 for generating a DC bias according to an embodiment of the present disclosure.

As shown in FIG. 3, the apparatus 300 comprises a voltage detector 310, a control signal generator 320, and a DC bias generator 330. The voltage detector 310 detects a system power supply voltage to detect an automobile start/stop operation and generate a trigger signal Vtrig. The detecting, for example, may be implemented by detecting change of a power supply voltage Vcc. The power supply voltage Vcc here is a power supply voltage provided by a battery of the automobile to the signal processor chip. During the normal operation, the power supply voltage Vcc is generally at a higher value 12V, while during the automobile engine start/stop operation, Vcc will drop to a lower value 4.5V. Therefore, by detecting change of Vcc, the automobile engine start/stop operation may be detected. Preferably, when Vcc drops from 12V to a predetermined threshold (e.g., 8V), it may be believed that the automobile engine start/stop operation is being performed. When detecting the automobile engine start/stop operation, the voltage detector may generate the trigger signal Vtrig. As will be detailed hereinafter, the Vtrig signal may be a voltage signal; however, for different circuit implementations, the values of the Vtrig signal during the start/stop operation might be somewhat different, which will be detailed infra. Besides, it may be understood that a certain amplitude relationship exists between the power supply voltage directly provided to the power supply voltage of the signal processor chip and an output voltage of the automobile battery; therefore, it is also possible to detect, for example, the start/stop operation by detecting an output voltage of the automobile battery.

The control signal generator 320 receives the trigger signal Vtrig, and generates a control signal for DC bias generation based on the trigger signal Vtrig, which control signal is for example a current control signal I1. The DC bias generator 330 receives control signal I1 and generates the DC bias based on the control signal I1, such that a DC bias having a first value is generated when the power supply voltage is the first voltage, while a DC bias having a second value is generated when the power supply voltage is a second voltage lower than the first voltage, wherein the first value is greater than the second value. Wherein the first voltage, for example, is a power supply voltage under a normal operation state, e.g., 12V, while the second voltage, for example, is the lowest power supply voltage 4.5V during the automobile engine start/stop operation. The first value, for example, is 3.3V, and the second value, for example, is 2.5V.

Figure 4:
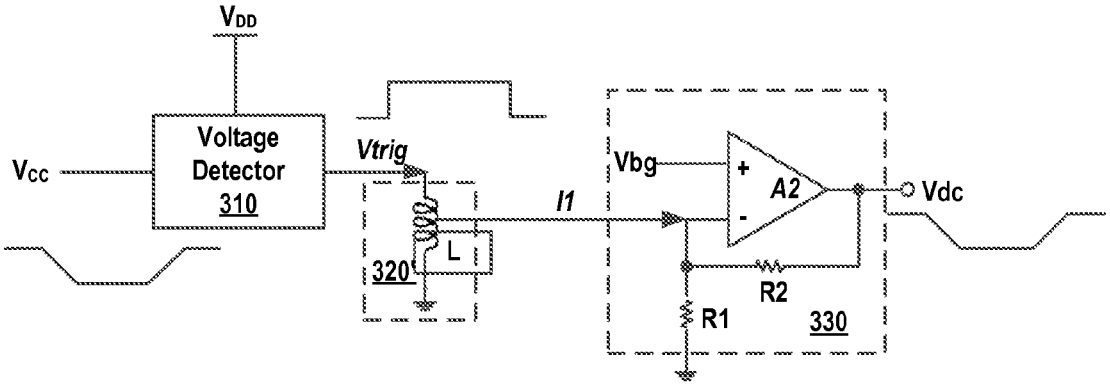
FIG. 4 schematically shows a circuit diagram of an apparatus for generating a DC bias according to an embodiment of the present disclosure.

FIG. 4 schematically illustrates a circuit diagram of an apparatus for generating a DC bias according to an embodiment of the present disclosure. As shown in FIG. 4, the power supply voltage Vcc is input into the voltage detector 310. The voltage detector 310 generates a trigger signal Vtrig based on the power supply voltage signal Vcc. For example, during the automobile engine start/stop operation, a Vtrig signal of high voltage, for example, is generated, while during the normal operation of the automobile engine, the Vtrig signal is kept low. The voltage detector 310 may comprise various circuit structures such as a threshold comparator or a mean value detector, and the like, which may be implemented by those skilled in the art in a plurality of manners based on the description herein, which will not be detailed. The detector 310 may be powered from a supply voltage Vdd.

Since the Vtrig signal is changed to a high voltage, a voltage drop exists at two ends of an inductor L; therefore, the current will flow through the inductor L; besides, the current gradually rises to the maximum current from zero within the coil transition time. Namely, the inductor L will smoothly increase the current flowing therethrough to the maximum current value. The current flowing through the inductor L may be mirrored into the DC bias generation circuit 330 through a mirror circuit, for using as the control signal I1 for controlling generation of the DC bias.

As shown in FIG. 4, the DC bias generator 330 comprises an amplifier A2, a resistor R1, and a resistor R2, wherein the resistor R1 and the resistor R2 are connected in series between the ground and an output end of the amplifier A2, while the middle node between the resistor R1 and the resistor R2 is connected to a negative input end of the amplifier A2. The negative input end further receives the control signal I1 from the control signal generator 320'. Besides, the positive input end of the amplifier receives an input signal Vbg. The input signal Vbg is a band gap voltage inside the signal processor.

Vcc is a high voltage when the engine works normally, while the Vtrig is kept at a low voltage. Therefore, no current flows through the inductor L. At this point, the control current I1 injected into the DC bias generator is also 0. Therefore, the DC bias at the output end of the amplifier A2 may be expressed as:

$$Vdc=Vbg*(1+R2/R1)$$

wherein Vdc indicates a voltage value of a DC bias, Vbg indicates the voltage value of the band gap voltage inputted at the positive input end of the amplifier, R1 indicates a resistance value of the resistor R1, and R2 indicates the resistance value of the resistor R2.

During the automobile engine start/stop operation, when the Vcc changes to a low voltage, Vtrig changes to a high voltage. Hence, the current flows through the inductor L, which means the mirror current I1 is injected into the amplifier A2. Therefore, at this point, the DC bias Vdc at the output end of the amplifier may be represented as:

$$Vdc=Vbg*(1+R2/R1)-I1*R2$$

Therefore, during the automobile engine start/stop operation, a trigger signal that is a high voltage signal is generated when the power supply voltage drops, and a control signal I1 is generated based on the high voltage signal, such that the DC bias during the start/stop operation drops to a value lower than the DC bias during normal operation. In this way, when the power supply voltage resumes the normal operation, the Vtrig signal will become a low voltage signal; thus, the control current I1 gradually decreases to zero, and finally, the DC bias is caused to resume a higher DC bias. Accordingly, a dynamic DC bias may be realized. Besides, use of the inductor L will cause the switch of the DC bias between a higher value and a lower value much smoother, thereby realizing a better audio effect.

Figure 5:
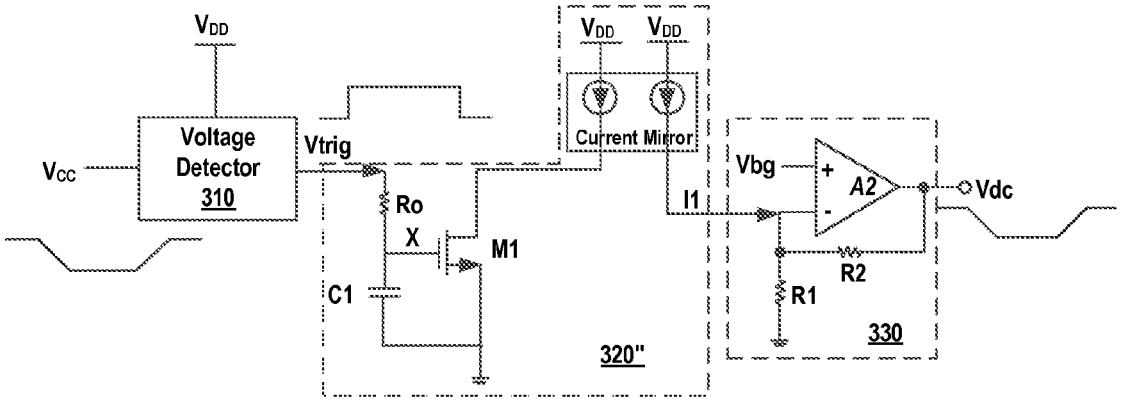
FIG. 5 schematically shows a circuit diagram of an apparatus for generating a DC bias according to another embodiment of the present disclosure.

The dynamic DC bias may also be implemented based on an equivalent inductive circuit. Reference is made to FIG. 5, which schematically illustrates a circuit diagram of an apparatus for generating a DC bias for automobile engine operations according to another embodiment of the present disclosure. In the circuit of FIG. 5, the voltage detector 310 and the DC bias generator 330 are identical to those in FIG. 4, which will not be detailed herein. Different from the inductor-based implementation as shown in FIG. 4, the control signal generator 320" comprises an equivalent inductor L comprising a resistor Ro, a capacitor C1, a NMOS transistor M1. FIG. 5 further shows a current mirror circuit. As shown in FIG. 5, an output end of the voltage detector 310 is connected to one end of the resistor Ro, and the other end of the resistor Ro is connected to the capacitor C1, while the other end of the capacitor C1 is grounded. The end of the resistor Ro connected to the capacitor C1 is connected to a gate of the transistor M1. A source of the transistor M1 is grounded, and its drain is connected to a current input end of the current mirror, and the mirror output end of the current mirror is connected to a negative input end of the amplifier A2. In the circuit shown in FIG. 5, the resistor Ro, the capacitor C1, and the transistor M1 form an equivalent inductive circuit, and the current flowing through M1 is mirrored into I1 by means of a current mirror. The current signal I1, as a control signal, is injected into a negative input end of the amplifier A2. During normal operation, the Vcc is a high-voltage signal, the Vtrig is a low-voltage signal (e.g., 0V); at this point, the transistor M1 is turned off, and no current flows through the transistor M1. Therefore, the control signal I1 is also 0. However, when Vcc is changed to a low voltage, the Vtrig signal changes to a high voltage signal (e.g., Vdd, 4.2V). At this point, C1 is electrically charged and thus the voltage Vx at node X rises gradually, which will cause turn-on of the transistor M1. In this way, due to the fact the drain of the transistor M1 is connected to the current input of the current mirror current, the current flowing through the transistor M1 will be mirrored into current I1 at the mirror current output end, which current I1 is then injected to the amplifier A2.

However, in order to realize a current switch within a time of milliseconds (e.g., 2 ms), a larger inductor is usually required. This means a larger capacitor and resistor are also needed in the RC-based implementation. However, use of larger resistor and larger capacitor will occupy a larger area on the circuit. Besides, whether current I1 is accurate also depends on the Vtrig signal and the transistor M1.

Figure 6:
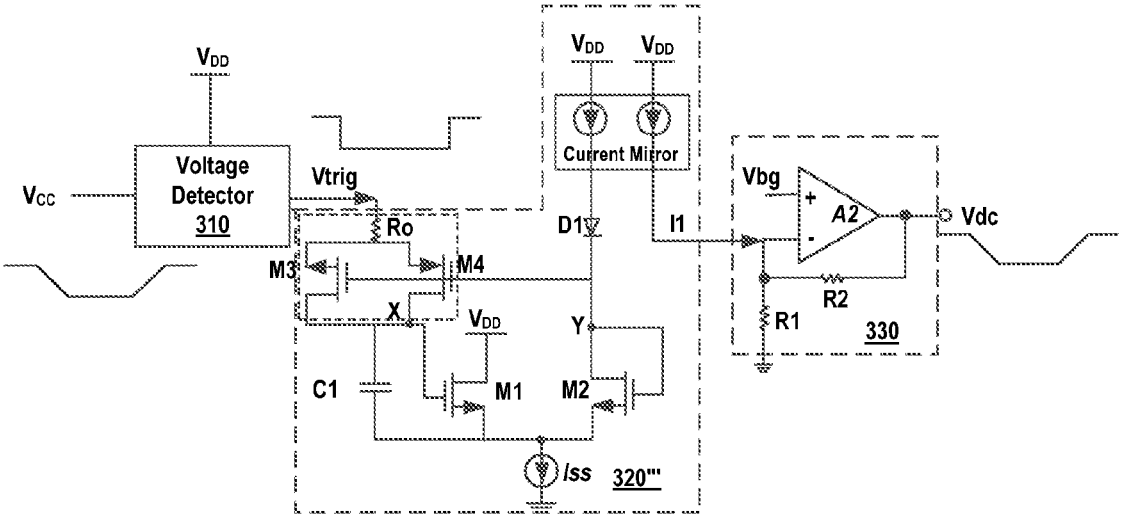
FIG. 6 schematically shows a circuit diagram of an apparatus for generating a DC bias according to a further embodiment of the present disclosure.

To this end, FIG. 6 further provides a circuit diagram of an apparatus for generating a DC bias according to a further embodiment of the present disclosure. As shown in FIG. 6, in the control signal generator 320"' as shown, both a resistance-multiplier-circuit and a source couple pair structure are employed. In FIG. 6, the resistance multiplier circuit comprises a resistor Ro and an NMOS transistor M3 and a PMOS transistor M4. One end of the resistor Ro is connected to the output end of the voltage detector 310; the other end thereof is connected to sources the transistor M3 and of the transistor M4; the transistor M3 is connected to the drain of the transistor M4 and is further connected to the capacitor C1. The other end of the capacitor C1 is connected to a tail current source Iss. The other end of the tail current source Iss is grounded. Therefore, in the circuit diagram of FIG. 6, the resistor Ro and the transistor M3 constitute an N-type common source stage with source degeneration, while the resistor Ro and the transistor M4 form a P-type common source stage with source degeneration.

The circuit of FIG. 6 also comprises an NMOS transistor M1, a gate of which is connected to a middle node between the capacitor and the multiplication resistor circuit. However, the drain of the transistor is connected to the internal power supply voltage VDD of the automobile signal processor, and its source is connected to the tail current source Iss. In addition to the transistor M1, there further comprises a NMOS transistor M2. The sources of the transistor M2 and the transistor M1 are connected together. The gate and drain of the transistor M2 are connected together and connected to an input end of the current mirror through the diode D1. The gates of the transistors M3 and M4 are commonly connected to the gate of the transistor M2. Therefore, in the circuit diagram of FIG. 6, transistors M1 and M2 jointly form a source couple pair. Such circuit structure as shown in FIG. 6 can ensure that with the change of voltage difference at points X, Y, the current of the tail current source Iss finally flows through M1 or M2 in an alternative manner.

Figure 7:
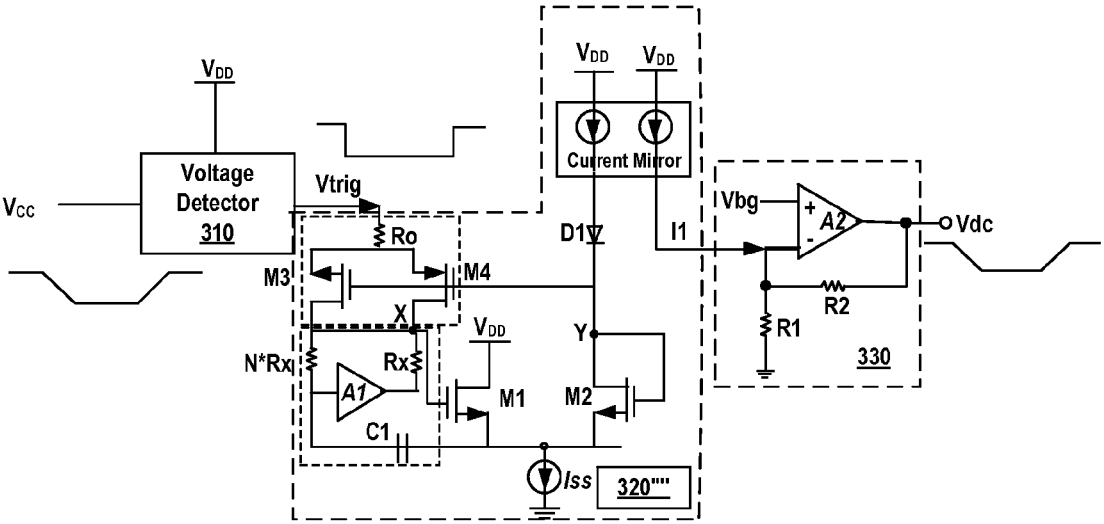
FIG. 7 schematically shows a circuit diagram of an apparatus for generating a DC bias according to a still further embodiment of the present disclosure.
Figure 8:
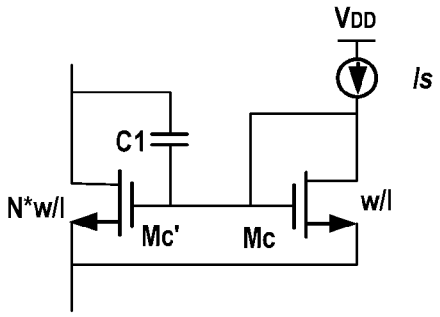
FIG. 8 schematically shows a circuit diagram of an alternative capacitance multiplier that may be used in an apparatus for generating a DC bias according to the present disclosure.

FIG. 7 further schematically shows a circuit diagram of an apparatus for generating a DC bias according to a further embodiment of the present disclosure. Compared with the circuit shown in FIG. 6, the control signal generator 320"" comprises a capacitance multiplier circuit, rather than a single capacitor. As shown in FIG. 7, the capacitance multiplier circuit comprises a resistor Rx, a resistor N*Rx, A1, and C1. One end of the resistor Rx is connected to the drains of the transistors M3 and M4, while the other end is connected to the output end of the amplifier A1 (e.g., OTA). Similarly, one end of the resistor N*Rx is also connected to the drains of the transistors M3 and M4 and the other end is connected to the capacitor C1 and the input end of the amplifier A1. The resistor Rx, resistor N*Rx, A1 and C1 forms an equivalent capacitive circuit with an equivalent capacitance value of (N+1)*C1.

Besides the capacitance multiplier circuit used in FIG. 7, another type of capacitance multiplier circuit may also be adopted. For example, FIG. 8 further schematically shows a circuit diagram of an alternative capacitance multiplier that may be used by the apparatus for generating DC bias. As illustrated, different from FIG. 7, the capacitance multiplier circuit is a transistor-based current type capacitance multiplier. The capacitance multiplier circuit comprises a capacitor C1, a circuit source Is and two NMOS transistors Mc and Mc', wherein the transistors Mc and Mc' have width-length ratios of w/l and N*w/l, respectively. The gate and source of the transistor Mc are connected to the gate and source of the transistor Mc', respectively. The drain and source of the transistor Mc are also connected together and are connected to the current source Is. The other end of the current source Is is connected to the power supply voltage VDD inside the system. The gate and drain of the transistor Mc' are connected to two ends of the capacitor C1. Through such a capacitive equivalent circuit, an equivalent capacitance value of (N+1)*C1 may also be provided. In this way, a smaller capacitance may be utilized to realize a larger transition time. However, it should be noted that those skilled in the art, based on the description here, may also envisage several capacitance multiplier circuits in other structures, and the present invention is not limited to the embodiments as shown.

Figure 9:
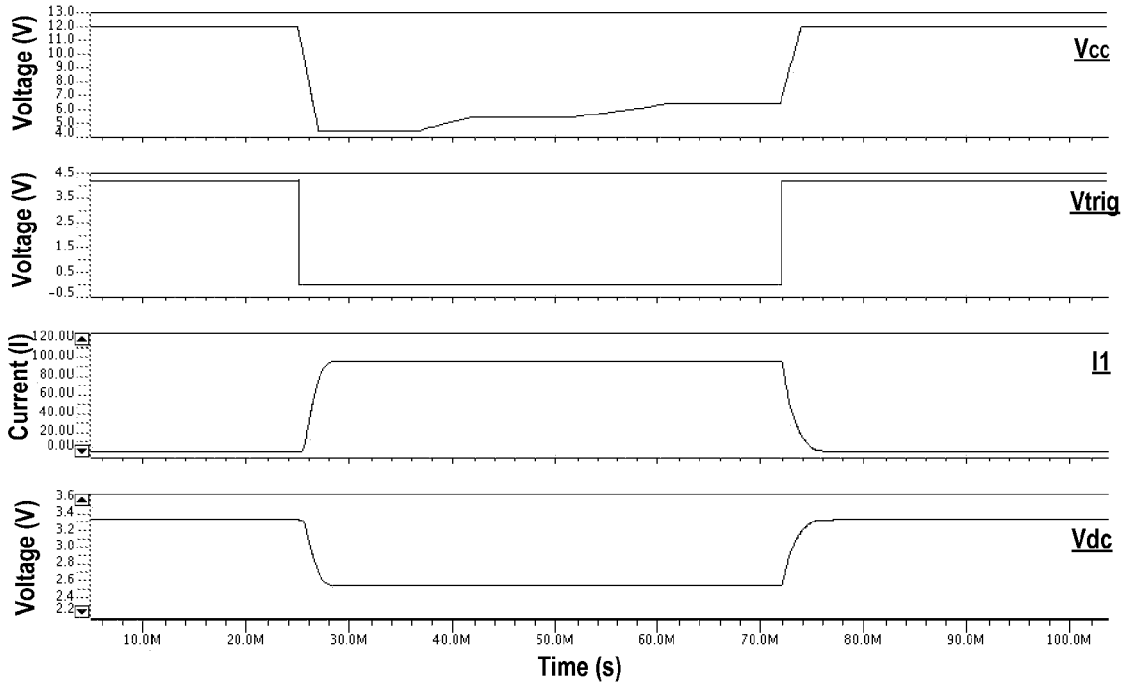
FIG. 9 schematically shows a signal timing diagram during start/stop operation of an automobile engine.

Next, FIG. 9 will be referenced to describe in detail the work principles of the circuits of FIGS. 6 and 7. As shown in FIG. 9, when the automobile start/stop operation starts, the power supply voltage Vcc shifts from a high voltage (12V) to a low voltage (4.5V), which will trigger a threshold window. This window, for example, may be defined through a predetermined voltage threshold (such as 8V) or a predetermined percentage value. Once the threshold window is triggered, it will generate a trigger signal, i.e., the Vtrig signal will change from a high voltage (e.g., VDD) to a low voltage (e.g., 0V). At this point, in the circuit diagram as shown in FIGS. 6 and 7, the transistor M4 will be turned off, and the transistor M3 will be turned on. Thus, the voltage Vx at the connection point (i.e., X point) of drains of the transistors M3 and M4 will flow through the transistor M3.

The resistor Ro and the equivalent capacitance circuit are discharged. The transition time constant τ1 is equal to:

$$\tau 1=(gm3*ro3*Ro)*((N+1)*C1)$$

wherein gm3 indicates the transcondutance of the transistor M3, and ro3 indicates the conductive resistance of the transistor M3.

In the circuit diagram as shown in FIG. 7, since the transcondutance multiplier circuit and the capacitance multiplier circuit prolong the transition time, such that even a smaller resistor Ro and a smaller capacitor C1 are used, it can also realize a greater transition time constant, thereby realizing smooth transition.

Therefore, Vx will be smoothly discharged to a lower value within the transition time. Meanwhile, with gradual discharge of Vx, the current of the tail current source Iss will gradually flow through the transistor M2, and the voltage $V_Y$ at the drain (point Y) of the transistor M2 will gradually drop. In this way, the voltage difference between $V_Y$ and Vtrig will gradually decrease, which will be advantageous to prolong the discharge time. Finally, since the final voltage value of the Vx after discharging is low, the transistor M1 is turned off, and the tail current Iss will not flow through the transistor M1. In this way, the current of the tail current source Iss will completely flow through the transistor M2, and then flow through the diode D1. Meanwhile, the current mirror circuit will mirror the current flowing through the diode D1 into I1, and inject I1 into the negative input end of the amplifier A2. Therefore, the output Vdc of the amplifier A2 may be represented as Vdc=Vbg*(1+R2/R1)−I1*R2. Thus, the DC bias may change from a higher value to a lower value, as shown in FIG. 9.

On the other hand, upon the end of the start/stop operation, the Vcc will rise and in turn trigger the threshold window. This means Vtrig will change from a low voltage (e.g., 0V) to a high voltage (e.g., $V_{DD}$). Since Vtrig is a high voltage, the transistor M3 will be turned off, and the transistor M4 will be turned on. Therefore, Vtrig will charge point X through the transistor M4, resistor Ro, and capacitance multiplier, which means the voltage Vx at point X will rise gradually. At this point, the transition time constant is:

$$\tau 2=(gm4*ro4*Ro)*((N+1)*C1)$$

wherein gm4 denotes transconductance of the transistor M4, ro4 denotes the conductive resistance of the transistor M4. Likewise, because the resistance multiplier circuit and capacitance multiplier circuit are used to prolong time, even if a smaller resistor Ro and the capacitor C1 are used, it may also achieve a larger transition time constant, thereby realizing a smooth transition.

Meanwhile, with gradual charge of Vx, the current of the tail current source Iss will gradually flow out of the transistor M2, and the voltage $V_Y$ at the drain (point Y) of the transistor M2 will rise gradually. In this way, the voltage difference between Vtrig and $V_Y$ will decrease gradually, which will be advantageous to prolong the charge time. When the Vx is charged to the final value $V_{DD}$, due to use of the diode D1, it may be ensured that Vx voltage is greater than VY. Therefore, all tail currents will flow through M1, and no current will flow through M2. Since no tail current flows through the diode D1, the current I1 mirrored by the current mirror will be 0, i.e., no current is injected into a negative input end of the comparison amplifier A2. Meanwhile, the voltage $V_Y$ at Y will rise. In this way, the output Vdc of the comparison amplifier turns again to Vdc=Vbg*(1+R2/R1), as shown in FIG. 9.

Therefore, in the present invention, alternative turn-on and turn-off of M3 and M4 enables the tail current to alternatively flow through M1 and M2, such that the DC bias may be dynamically adjusted at the start of start/stop and at the end of start/stop.

Figure 10:
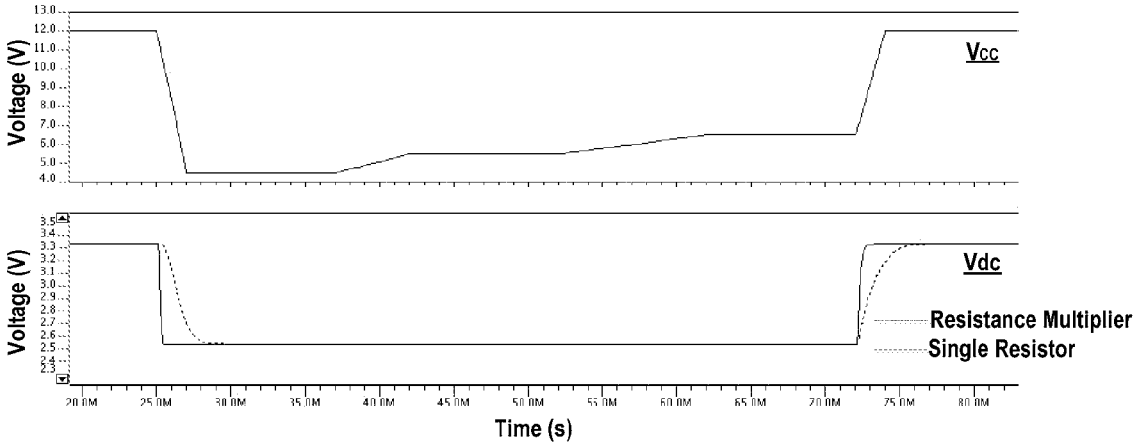
FIG. 10 schematically shows curve diagrams of a DC bias when adopting a single resistor and adopting a resistance multiplier.

FIG. 10 further schematically shows the transition time of a DC bias in the case of employing a single resistor Ro and employing a resistance multiplier. As shown in FIG. 10, a circuit employing the resistance multiplier can effectively prolong the transition time, such that the transition of the DC bias voltage will become smoother, rather than a steep change like using a single resistor Ro.

Based on the present disclosure, a dynamic DC bias may be realized, which may not only support a larger voltage range but also significantly improve the signal to noise ratio of the signal during normal operation. According to referred embodiments of the present invention, smooth transition upon DC bias adjustment may also be realized. Additionally, it provides a simple and cost-effective implementation manner.

Figure 11:
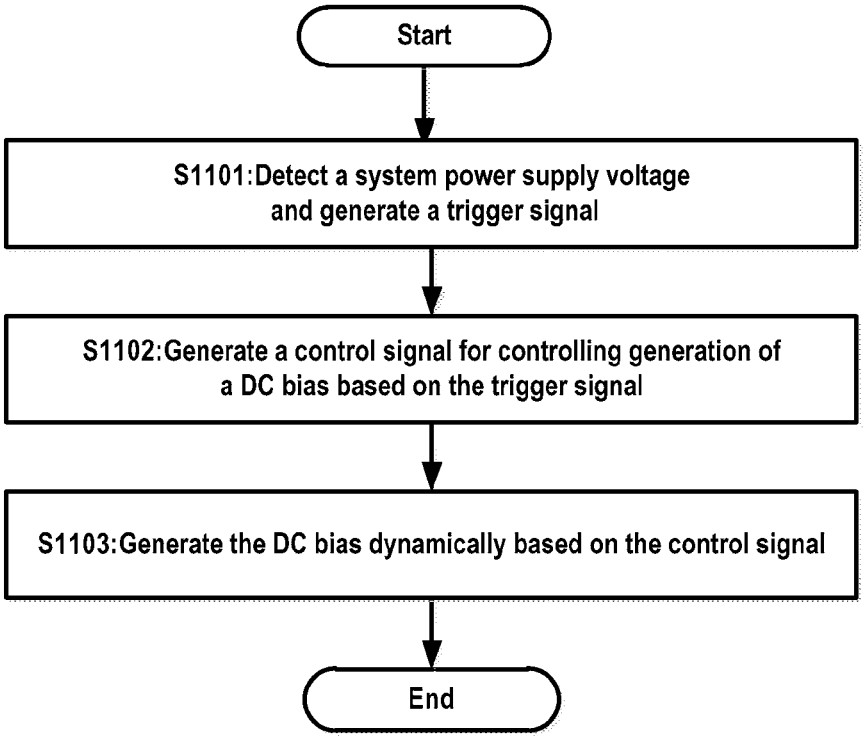
FIG. 11 schematically shows a flow chart of a method for generating a DC bias according to an embodiment of the present disclosure.

A method for generating a direct current DC bias will now be described with reference to FIG. 11. As shown in FIG. 11, first, at step S1101, a system power supply voltage is measured and a trigger signal at an output end is generated. Next, at step S1102, a control signal for controlling generation of the DC bias is generated based on the trigger signal. Then, at step S1103, the DC bias is dynamically generated based on the control signal, namely, when the power supply voltage is a first voltage, the DC bias having a first value is generated; while when the power supply voltage is a second voltage different from the first voltage, the DC bias having a second value is generated, wherein the first value is different from the second value. Preferably, the DC bias transits smoothly between the first value and the second value.

According to one embodiment of the present disclosure, the generating a control signal for controlling generation of the DC bias may comprise: generating a current signal through an inductive circuit based on the trigger signal, and generating a mirror signal of the current signal by means of a mirror circuit as the control signal. The inductive circuit may comprise an inductor or an equivalent inductive circuit. The equivalent inductive circuit may comprise a resistive circuit and a capacitive circuit. The resistive circuit may comprise a resistance multiplier for achieving equivalent multiplication resistance. The capacitive circuit may also comprise a capacitance multiplier for achieving equivalent multiplication capacitance.

It should be noted that the specific operations of the method are substantially similar to the operations of the circuits as mentioned above. Therefore, for specific details about the method, reference is made to the description of the apparatus with reference to FIGS. 2 to 10, which will not be detailed here.

It should be noted that the embodiments have been described above with reference to specific numerical values. However, the embodiments are not limited thereto. In fact, the numerical values as quoted in relevant description would change in different applications.

Besides, it should be noted that the embodiments have been described in detail with regard to generation of the DC bias during the automobile engine start/stop operation. However, the disclosure is not limited thereto. Instead, the embodiments may be applied to any other similar applications in which a fixed DC bias might cause degradation of signal quality or other issues.

Besides, it should be noted that the embodiments are directed to a flexible solution for generating a DC bias. Although it is described that a higher DC bias is set when the power supply voltage is of a higher value and a lower DC bias is set when the power supply voltage is relatively low, in different applications, there might exist different situations, i.e., a lower bias is set for a higher power supply voltage, and a higher bias is set for a lower power supply voltage.

It should also be noted that the exemplary circuit diagram as schematically shown hereinabove describes the structure and operation of various circuit diagrams. However, the embodiments are not limited thereto. Without departing from the true spirit of the present disclosure, those skilled in the art may make various kinds of additions, deletions and improvements to the circuit structure.

Besides, those skilled in the art should understand, the descriptions in the present description are only illustrative, and should not be construed as limitative. The scope of the present disclosure is only limited by the appended claims.

What is claimed is:

1. An apparatus, comprising:

a voltage detector having a first input configured to receive a supply voltage and a second input configured to receive a DC system power supply signal, said voltage detector operating when powered by the supply voltage to generate a trigger signal at an output that is indicative of a detected change in non-zero voltages of the DC system power supply signal at the second input;

a control signal generator configured to receive the trigger signal and generate a control signal for controlling generation of a DC bias based on the trigger signal; and a DC bias generator configured to receive the control signal at a control input and generate the DC bias based on the control signal, such that the DC bias having a first value is generated when the DC system power supply signal is at a first non-zero voltage, while the DC bias having a second value is generated when the DC system power supply signal is at a second non-zero voltage different from the first non-zero voltage, wherein the first value is different from the second value;

wherein the control signal generator comprises an inductive circuit and a mirror circuit, said inductive circuit connected between the output of the voltage detector and a reference node, and a current flowing through the inductive circuit generates a mirror current through the mirror circuit as the control signal to be injected into the control input of the DC bias generator.

2. The apparatus according to claim 1, wherein the DC bias generator is configured to generate the DC bias transitioning smoothly between the first value and the second value.

3. The apparatus according to claim 1, wherein the inductive circuit comprises an equivalent inductive circuit.

4. The apparatus according to claim 3, wherein the equivalent inductive circuit comprises a resistive circuit, a capacitive circuit, and a transistor circuit, wherein the resistive circuit and the capacitive circuit are connected in series, and wherein the transistor circuit is connected between the current mirror circuit and the reference node and connected to a middle node between the resistive circuit and the capacitive circuit.

5. The apparatus according to claim 4, wherein the resistive circuit comprises a resistor, the capacitive circuit comprises a capacitor, the transistor circuit comprises a transistor, the resistor and the capacitor are serially coupled between the output of the voltage detector and the reference node, a source of the transistor is coupled to the reference node, a gate of the transistor is coupled to a middle node between the transistor and the capacitor, and a mirror output of the mirror circuit is connected to the control input of the DC bias generator.

6. The apparatus according to claim 4, wherein the resistive circuit comprises a resistance multiplier configured to achieve a multiplication equivalent resistance.

7. The apparatus according to claim 6, wherein the resistance multiplier comprises a resistor, a first NMOS transistor, and a PMOS transistor, wherein the resistor and the NMOS transistor constitute an N-type common source stage with source degeneration, and the resistor and the PMOS transistor constitute a P-type common source stage with source degeneration.

8. The apparatus according to claim 7, wherein the transistor circuit comprises a second NMOS transistor and a third NMOS transistor connected in a common source configuration, wherein a source of the second NMOS transistor and a source of the third NMOS transistor are coupled to a reference node through a tail current source, a drain of the second NMOS transistor is connected with an internal supply voltage node and a gate of the second NMOS transistor is connected to a middle node between the resistor circuit and the capacitive circuit, and wherein a drain and a gate of the third NMOS transistor, which are connected together, are connected with gates of the first NMOS transistor and the PMOS transistor and connected to the current input of the mirror circuit through a diode.

9. The apparatus according to claim 4, wherein the capacitive circuit comprises a capacitance multiplier configured to achieve a multiplier equivalent capacitance.

10. The apparatus according to claim 9, wherein the capacitance multiplier comprises an amplifier-based current-type capacitance multiplication circuit.

11. The apparatus according to claim 9, wherein the capacitance multiplier comprises a transistor-based current-type capacitance multiplication circuit.

12. The apparatus according to claim 1, wherein the DC bias generator comprises an amplifier, and a first resistor and a second resistor, wherein the first resistor and the second resistor are connected in series between the reference node and an output of the amplifier, and a middle node therebetween is connected to a negative input of the amplifier, a positive input of the amplifier configured to receive an internal band gap signal.

13. The apparatus according to claim 1, wherein the first non-zero voltage is greater than the second non-zero voltage and the first value is greater than the second value.

14. The apparatus according to claim 1, wherein the voltage detector is configured to detect a start-stop operation of an automobile engine through detecting the system power supply signal.

15. The apparatus according to claim 1, wherein the trigger signal has a first digital value indicating that the DC system power supply signal has a voltage that is above a threshold voltage, the DC bias having the first non-zero value in response to the first digital value, and has a second digital value indicating that the DC system power supply signal has a voltage that is below the threshold voltage, the DC bias having the second non-zero value in response to the second digital value.

16. A method, comprising:

detecting a DC system power supply signal and generating a trigger signal that is indicative of a detected change in non-zero voltages of the DC system power supply signal;

generating a control signal for controlling generation of a DC bias based on the trigger signal; and generating the DC bias based on the control signal, such that the DC bias having a first value is generated when the DC system power supply signal is at a first non-zero voltage, while the DC bias having a second value is generated when the DC system power supply signal is at a second non-zero voltage different from the first non-zero voltage, wherein the first value is different from the second value;

wherein generating a control signal for controlling generation of a DC bias comprises: generating a current signal via an inductive circuit based on the trigger signal, and generating a mirror signal of the current signal by means of a mirror circuit as the control signal.

17. The method according to claim 16, wherein the DC bias transitions smoothly between the first value and the second value.

18. The method according to claim 16, wherein the inductive circuit comprises an equivalent inductive circuit, and wherein the equivalent inductive circuit comprises a resistive circuit and a capacitive circuit.

19. The method according to claim 18, wherein the resistive circuit comprises a resistance multiplier for achieve a multiplication equivalent resistance.

20. The method according to claim 19, wherein the resistance multiplier comprises a resistor, an NMOS transistor, and a PMOS transistor, wherein the resistor and the NMOS transistor constitute an N-type common source stage with source degeneration, and the resistor and the PMOS transistor constitute a P-type common source stage with source degeneration.

21. The method according to claim 20, wherein generating a control signal for controlling generation of a DC bias based on the trigger signal comprises: during a period in which the DC power supply signal is at the first non-zero voltage, the resistor and the PMOS transistor operate to generate a current signal with a value of zero, and during a period in which the DC power supply signal is at the second non-zero voltage, the resistor and the NMOS transistor operate to generate a current signal with a value greater than zero.

22. The method according to claim 18, wherein the capacitive circuit comprises a capacitance multiplier for achieving a multiplication equivalent capacitance.

23. The method according to claim 16, wherein the first non-zero voltage is greater than the second non-zero voltage and the first value is greater than the second value.

24. The method according to claim 16, wherein start-stop operation of an automobile engine is detected through detecting the system power supply voltage.

25. The method according to claim 16, wherein the trigger signal has a first digital value indicating that the DC system power supply signal has a voltage that is above a threshold voltage and has a second digital value indicating that the DC system power supply signal has a voltage that is below the threshold voltage, and wherein the DC bias is generated with the first non-zero value in response to the first digital value and the DC bias is generated with the second non-zero value in response to the second digital value.

26. An apparatus, comprising:

a voltage detector having a first input configured to receive a supply voltage and a second input configured to receive a DC system power supply signal, said voltage detector operating when powered by the supply voltage to generate a trigger signal at an output that is indicative of a detected change in non-zero voltages of the DC system power supply signal at the second input;

a control signal generator configured to receive the trigger signal and generate a control signal for controlling generation of a DC bias based on the trigger signal; and a DC bias generator configured to receive the control signal at a control input and generate the DC bias based on the control signal, such that the DC bias having a first value is generated when the DC system power supply signal is at a first non-zero voltage, while the DC bias having a second value is generated when the DC system power supply signal is at a second non-zero voltage different from the first non-zero voltage, wherein the first value is different from the second value;

wherein the DC bias generator comprises an amplifier, and a first resistor and a second resistor, wherein the first resistor and the second resistor are connected in series between the reference node and an output of the amplifier, and a middle node therebetween is connected to a negative input of the amplifier, a positive input of the amplifier configured to receive an internal band gap signal.

27. The apparatus according to claim 26, wherein the DC bias generator is configured to generate the DC bias transitioning smoothly between the first value and the second value.

28. The apparatus according to claim 26, wherein the control signal generator comprises an inductive circuit and a mirror circuit, said inductive circuit connected between the output of the voltage detector and a reference node, and a current flowing through the inductive circuit generates a mirror current through the mirror circuit as the control signal to be injected into the control input of the DC bias generator.

29. The apparatus according to claim 28, wherein the inductive circuit comprises an equivalent inductive circuit.

30. The apparatus according to claim 29, wherein the equivalent inductive circuit comprises a resistive circuit, a capacitive circuit, and a transistor circuit, wherein the resistive circuit and the capacitive circuit are connected in series, and wherein the transistor circuit is connected between the current mirror circuit and the reference node and connected to a middle node between the resistive circuit and the capacitive circuit.

31. The apparatus according to claim 30, wherein the resistive circuit comprises a resistor, the capacitive circuit comprises a capacitor, the transistor circuit comprises a transistor, the resistor and the capacitor are serially coupled between the output of the voltage detector and the reference node, a source of the transistor is coupled to the reference node, a gate of the transistor is coupled to a middle node between the transistor and the capacitor, and a mirror output of the mirror circuit is connected to the control input of the DC bias generator.

32. The apparatus according to claim 30, wherein the resistive circuit comprises a resistance multiplier configured to achieve a multiplication equivalent resistance.

33. The apparatus according to claim 32, wherein the resistance multiplier comprises a resistor, a first NMOS transistor, and a PMOS transistor, wherein the resistor and the NMOS transistor constitute an N-type common source stage with source degeneration, and the resistor and the PMOS transistor constitute a P-type common source stage with source degeneration.

34. The apparatus according to claim 33, wherein the transistor circuit comprises a second NMOS transistor and a third NMOS transistor connected in a common source configuration, wherein a source of the second NMOS transistor and a source of the third NMOS transistor are coupled to a reference node through a tail current source, a drain of the second NMOS transistor is connected with an internal supply voltage node and a gate of the second NMOS transistor is connected to a middle node between the resistor circuit and the capacitive circuit, and wherein a drain and a gate of the third NMOS transistor, which are connected together, are connected with gates of the first NMOS transistor and the PMOS transistor and connected to the current input of the mirror circuit through a diode.

35. The apparatus according to claim 30, wherein the capacitive circuit comprises a capacitance multiplier configured to achieve a multiplier equivalent capacitance.

36. The apparatus according to claim 35, wherein the capacitance multiplier comprises an amplifier-based current-type capacitance multiplication circuit.

37. The apparatus according to claim 35, wherein the capacitance multiplier comprises a transistor-based current-type capacitance multiplication circuit.

38. The apparatus according to claim 26, wherein the first non-zero voltage is greater than the second non-zero voltage and the first value is greater than the second value.

39. The apparatus according to claim 26, wherein the voltage detector is configured to detect a start-stop operation of an automobile engine through detecting the system power supply signal.

40. An apparatus, comprising:

a voltage detector having a first input configured to receive a supply voltage and a second input configured to receive a DC system power supply signal, said voltage detector operating when powered by the supply voltage to generate a trigger signal at an output that is indicative of a detected change in non-zero voltages of the DC system power supply signal at the second input;

a control signal generator configured to receive the trigger signal and generate a control signal for controlling generation of a DC bias based on the trigger signal; and a DC bias generator configured to receive the control signal at a control input and generate the DC bias based on the control signal, such that the DC bias having a first value is generated when the DC system power supply signal is at a first non-zero voltage, while the DC bias having a second value is generated when the DC system power supply signal is at a second non-zero voltage different from the first non-zero voltage, wherein the first value is different from the second value;

wherein the trigger signal has a first digital value indicating that the DC system power supply signal has a voltage that is above a threshold voltage, the DC bias having the first non-zero value in response to the first digital value, and has a second digital value indicating that the DC system power supply signal has a voltage that is below the threshold voltage, the DC bias having the second non-zero value in response to the second digital value.

41. The apparatus according to claim 40, wherein the DC bias generator is configured to generate the DC bias transitioning smoothly between the first value and the second value.

42. The apparatus according to claim 40, wherein the control signal generator comprises an inductive circuit and a mirror circuit, said inductive circuit connected between the output of the voltage detector and a reference node, and a current flowing through the inductive circuit generates a mirror current through the mirror circuit as the control signal to be injected into the control input of the DC bias generator.

43. The apparatus according to claim 42, wherein the inductive circuit comprises an equivalent inductive circuit.

44. The apparatus according to claim 43, wherein the equivalent inductive circuit comprises a resistive circuit, a capacitive circuit, and a transistor circuit, wherein the resistive circuit and the capacitive circuit are connected in series, and wherein the transistor circuit is connected between the current mirror circuit and the reference node and connected to a middle node between the resistive circuit and the capacitive circuit.

45. The apparatus according to claim 44, wherein the resistive circuit comprises a resistor, the capacitive circuit comprises a capacitor, the transistor circuit comprises a transistor, the resistor and the capacitor are serially coupled between the output of the voltage detector and the reference node, a source of the transistor is coupled to the reference node, a gate of the transistor is coupled to a middle node between the transistor and the capacitor, and a mirror output of the mirror circuit is connected to the control input of the DC bias generator.

46. The apparatus according to claim 44, wherein the resistive circuit comprises a resistance multiplier configured to achieve a multiplication equivalent resistance.

47. The apparatus according to claim 46, wherein the resistance multiplier comprises a resistor, a first NMOS transistor, and a PMOS transistor, wherein the resistor and the NMOS transistor constitute an N-type common source stage with source degeneration, and the resistor and the PMOS transistor constitute a P-type common source stage with source degeneration.

48. The apparatus according to claim 47, wherein the transistor circuit comprises a second NMOS transistor and a third NMOS transistor connected in a common source configuration, wherein a source of the second NMOS transistor and a source of the third NMOS transistor are coupled to a reference node through a tail current source, a drain of the second NMOS transistor is connected with an internal supply voltage node and a gate of the second NMOS transistor is connected to a middle node between the resistor circuit and the capacitive circuit, and wherein a drain and a gate of the third NMOS transistor, which are connected together, are connected with gates of the first NMOS transistor and the PMOS transistor and connected to the current input of the mirror circuit through a diode.

49. The apparatus according to claim 44, wherein the capacitive circuit comprises a capacitance multiplier configured to achieve a multiplier equivalent capacitance.

50. The apparatus according to claim 49, wherein the capacitance multiplier comprises an amplifier-based current-type capacitance multiplication circuit.

51. The apparatus according to claim 49, wherein the capacitance multiplier comprises a transistor-based current-type capacitance multiplication circuit.

52. The apparatus according to claim 40, wherein the DC bias generator comprises an amplifier, and a first resistor and a second resistor, wherein the first resistor and the second resistor are connected in series between the reference node and an output of the amplifier, and a middle node therebetween is connected to a negative input of the amplifier, a positive input of the amplifier configured to receive an internal band gap signal.

53. The apparatus according to claim 40, wherein the first non-zero voltage is greater than the second non-zero voltage and the first value is greater than the second value.

54. The apparatus according to claim 40, wherein the voltage detector is configured to detect a start-stop operation of an automobile engine through detecting the system power supply signal.

55. A method, comprising:

detecting a DC system power supply signal and generating a trigger signal that is indicative of a detected change in non-zero voltages of the DC system power supply signal;

generating a control signal for controlling generation of a DC bias based on the trigger signal; and generating the DC bias based on the control signal, such that the DC bias having a first value is generated when the DC system power supply signal is at a first non-zero voltage, while the DC bias having a second value is generated when the DC system power supply signal is at a second non-zero voltage different from the first non-zero voltage, wherein the first value is different from the second value;

wherein the trigger signal has a first digital value indicating that the DC system power supply signal has a voltage that is above a threshold voltage and has a second digital value indicating that the DC system power supply signal has a voltage that is below the threshold voltage, and wherein the DC bias is generated with the first non-zero value in response to the first digital value and the DC bias is generated with the second non-zero value in response to the second digital value.

56. The method according to claim 55, wherein the DC bias transitions smoothly between the first value and the second value.

57. The method according to claim 55, wherein generating a control signal for controlling generation of a DC bias comprises: generating a current signal via an inductive circuit based on the trigger signal, and generating a mirror signal of the current signal by means of a mirror circuit as the control signal.

58. The method according to claim 57, wherein the inductive circuit comprises an equivalent inductive circuit, and wherein the equivalent inductive circuit comprises a resistive circuit and a capacitive circuit.

59. The method according to claim 58, wherein the resistive circuit comprises a resistance multiplier for achieve a multiplication equivalent resistance.

60. The method according to claim 59, wherein the resistance multiplier comprises a resistor, an NMOS transistor, and a PMOS transistor, wherein the resistor and the NMOS transistor constitute an N-type common source stage with source degeneration, and the resistor and the PMOS transistor constitute a P-type common source stage with source degeneration.

61. The method according to claim 60, wherein generating a control signal for controlling generation of a DC bias based on the trigger signal comprises: during a period in which the DC power supply signal is at the first non-zero voltage, the resistor and the PMOS transistor operate to generate a current signal with a value of zero, and during a period in which the DC power supply signal is at the second non-zero voltage, the resistor and the NMOS transistor operate to generate a current signal with a value greater than zero.

62. The method according to claim 58, wherein the capacitive circuit comprises a capacitance multiplier for achieving a multiplication equivalent capacitance.

63. The method according to claim 55, wherein the first non-zero voltage is greater than the second non-zero voltage and the first value is greater than the second value.

64. The method according to claim 55, wherein start-stop operation of an automobile engine is detected through detecting the system power supply voltage.

* * * * *